US006395359B1

(12) United States Patent
McGrath et al.

(10) Patent No.: US 6,395,359 B1
(45) Date of Patent: May 28, 2002

(54) POWER CYLINDER NON-METALLIC LINER SEAL ASSEMBLY

(75) Inventors: James E. McGrath, Jamestown; Nicholas O. Venier, Tiverton, both of RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 08/910,844

(22) Filed: Aug. 13, 1997

(51) Int. Cl.[7] ..... E21D 15/52; E02D 5/60

(52) U.S. Cl. ..... 428/36.91; 405/211.1; 405/288; 405/290; 405/297; 428/36.92

(58) Field of Search ..... 428/36.92, 36.4, 428/35.8, 36.91; 427/409; 264/249, 330, 337, 348; 405/211.1, 288, 290, 297

(56) References Cited

U.S. PATENT DOCUMENTS 4,501,841 A * 2/1985 Herring ..... 524/411
5,348,425 A * 9/1994 Heiliger ..... 405/297
5,439,065 A * 8/1995 Georgi ..... 175/59
5,441,772 A * 8/1995 McAndrew et al. ..... 427/388.1
5,750,223 A * 5/1998 Tada et al. ..... 428/35.8

FOREIGN PATENT DOCUMENTS

JP 7236496 R * 9/1972 ..... 428/35.8

* cited by examiner

*Primary Examiner*—Harold Pyon
*Assistant Examiner*—Sandra M. Nolan
(74) *Attorney, Agent, or Firm*—Michael J. McGowan; James M. Kasischke; Prithvi C. Lall

(57) ABSTRACT

Corrosion resistance is provided for a power cylinder by providing a preloaded molded urethane elastomer sleeve liner within an outer cylinder of material such as a copper/nickel alloy which is subject to corrosion from long-term exposure to ambient fluids such as sea water. Preloading is preferably provided by thermal shrink fitting of the molded urethane sleeve liner to the inner bore of an outer metal cylinder. Preloading of a structure which has high structural integrity and low permeability thus effectively prevents incursion of fluids and gases at the interface between the outer cylinder and the sleeve liner as well as providing a surface which can be machined to a high degree of smoothness and against which reciprocating piston seals and wear assemblies can directly ride and which is resistant to abrasion therefrom even at high piston speeds.

4 Claims, 1 Drawing Sheet

POWER CYLINDER NON-METALLIC LINER SEAL ASSEMBLY

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention generally relates to cylinder and reciprocating piston assemblies for use under high pressure in high ambient pressure environments and, more particularly, to such assemblies which are exposed over long periods of time to corrosive liquids such as sea-water.

(2) Description of the Prior Art

Many ocean-going vessels and submarines, in particular, commonly include movable structures which require hydraulically or pneumatically derived forces to be applied in order to achieve the desired motion, either due to the size or mass of the movable structure, the speed of motion or acceleration to be achieved, static or dynamic pressures resisting such motion or because of inaccessibility of the structure to personnel. In some cases, high pressure air or steam can-be directly applied to portions of the structure to develop necessary forces. In other cases, cylinder and piston assemblies driven by high pressure air or steam are required in order to contain high relative pressures or to maintain separation between the fluid used to generate the force and ambient fluids, such as sea water. In particular, in numerous structures common on submersible vessels, such as launchers for various payloads, depth of submersion of the vessel may impose extreme hydrostatic pressures against which pneumatic or hydraulic pressure must work. The piston assembly must also prevent penetration of sea water into the launcher or the vessel when actuating pressure is not applied.

It has been found that a particularly critical application for cylinder and reciprocating piston assemblies is for an impulse or power cylinder in a launcher employed on submarines. In this application, the piston and load to which it is connected must be rapidly driven by high pressure (generally derived from high-pressure compressed air) to a velocity of approximately one hundred inches per second or more over a relatively short distance of a few feet. Transfer of a sufficient amount of fluid to a cylinder at sufficient pressure to achieve such accelerations of a load and acting against potentially large ambient hydrostatic pressure requires a specially constructed firing valve to be employed.

Cylinders for such an application are currently machined from a copper-nickel (CuNi) alloy which is of sufficient strength to withstand the pressures involved without requiring an unacceptable mass of material and exhibits a degree of corrosion resistance. A piston preferably made of nickel-aluminum-bronze (Ni—Al—Br) material, is arranged to ride within the inner bore of the cylinder. O-ring grooves, seals and other arrangements for preventing leakage of fluid past the piston within the bore of the cylinder are generally employed and the inner bore of the cylinder must be machined to a high degree of smoothness to prevent damage to the piston and seals. However, CuNi material is subject to crevice corrosion when in contact with sea water for extended periods of time. Such corrosion causes pitting of the inner bore of the cylinder. The pitted cylinder cannot be effectively sealed by structures provided on the piston and roughness due to such pitting may cause damage to the seals when the piston is moved.

Since the portion of the cylinder through which the piston must move is generally exposed to sea water and often at high hydrostatic pressures, as pitting increases, the piston becomes less effective in maintaining a separation of sea water from the portion of the inner bore of the cylinder to which pressure is applied. Leakage of sea water into this portion of the cylinder causes catastrophic failure of the firing valve. Failure of the firing valve will cause failure of a launch of payload apparatus which is potentially very expensive. Repair of the firing valve is also expensive and inconvenient. Repair at sea cannot generally be accomplished due to inaccessibility of the structure and the launch apparatus must generally remain non-functional until repairs can be accomplished.

Reworking the cylinder at the present state of the art has included the lining of the inner bore of the cylinder with a liner sleeve of CuNi material which is then machined to close tolerances to again prevent leakage past the piston. Other metal and alloy materials tend to accelerate the progress of corrosion and many cannot withstand the pressures and other severe operational conditions of the impulse cylinder and piston arrangement, such as the friction of the piston against the inner cylinder bore. However, as can readily be understood, the CuNi material of the liner sleeve is similarly subject to corrosion due to contact with sea water and the cycle of corrosion, leakage, catastrophic failure of the firing valve and replacement of the firing valve is repeated. Therefore, such corrosion presents a very substantial economic cost which has not been previously avoidable, particularly in the adverse conditions of the application and the extreme operating conditions of the cylinder and piston arrangement.

Providing corrosion protection for metal with a polymer coating is known. For example, U.S. Pat. No. 5,441,772 to McAndrew et al. teaches protection of carbon steel with nonconducting poly(aniline). U.S. Pat. No. 3,459,628 to Davis et al. teaches corrosion protection with a urethane foam composition and U.S. Pat. No. 3,012,710 to Steinacker teaches an elastomer liner for a centrifugal separator for corrosive liquids. U.S. Pat. No. 5,364,012 to Davis et al. and U.S. Pat. No. 3,738,527 to Townsend teach liners for liquid storage tanks which may be pressurized. However, such applications do not involve withstanding high impulse pressures with minimal distortion or resisting abrasion as would occur in a reciprocating piston and cylinder assembly.

Liners of metal are also known for piston and cylinder assemblies such as cast-iron liners in aluminum block internal combustion engines. However, in such an application, long-term exposure to a corrosive liquid is not generally involved or a degree of corrosion can be tolerated in view of ease of repair. Lubrication is also generally possible to increase resistance to abrasion and corrosion. However, such lubrication cannot be accomplished in the presence of long-term exposure to a corrosive liquid which will wash away any such material from the cylinder walls.

U.S. Pat. No. 5,348,425 to Heiliger discusses a French Patent Publication 1,202,536 which uses a thermoplastic material for lining a cylinder for a protective coating in a cylinder and piston assembly but notes that such coatings are permeable to oxygen and water and, if exposed thereto, form water and gas pockets at the interface of metal and the coating at which corrosion occurs. The gas or water pockets are driven along the interface between the metal and coating by the piston leading to peeling of the coating. In a mine prop, to which the Heiliger patent is directed, the thermoplastic coating would fail in such a way. Additionally, since mine props require a pressure differential to be applied across the piston for extended periods of time, a step deformation occurs due to the radial elasticity of the thermoplastic coating material. This step deformation damages ring seals which are used on the piston.

To avoid such deformation and other problems, Heiliger proposes the use of a three-dimensionally cross-linking thermosetting coating of 150–250 $\mu$m thickness on the cylinder interior and the exterior of the piston. However, the advantages gained by Heiliger in the application to a mine prop are achieved by reduction of the elasticity of the coating. Such an approach may be acceptable in such an application in which pressure is applied for long periods of time and changes in pressure are gradual but is not suitable for extreme impulse pressures. Also, in such an application, the resistance of such a coating to abrasion is of relatively little importance since piston velocity is very low. Further, in Heiliger and the French Patent Publication as described therein, the corrosion resistant material is applied as a coating to smooth the inner bore of the cylinder and reduce machining thereof as well as to achieve good adherence to high strength steel which is particularly subject to damage by corrosion. A coating, by its method of application (even if as a preformed sleeve) and, in the case of Heiliger, in-situ curing cannot achieve the high degree of structural integrity required when high impulse pressures are repeatedly applied, as in an internal combustion engine or an impulse cylinder for a payload launcher in a submersible vessel described above.

Accordingly, there has been no structure heretofore known which would simultaneously provide resistance to corrosion due to long-term exposure to corrosive and high-pressure liquids, capable of withstanding high impulse pressures (for example, 560 to 1350 psi above ambient pressure in the preferred impulse cylinder application) and the abrasion incident to high acceleration and speed of a piston and highly effective and reliable for maintaining a separation between the corrosive fluid and other structures.

SUMMARY OF THE INVENTION

It is therefore an object of the present invention to provide a sea water resistant, corrosion resistant, non-metallic liner for a sealing surface of a reciprocating piston and cylinder arrangement.

It is a another object of the invention to provide an economical and simplified method of fabricating or reworking a reciprocating piston and cylinder arrangement to achieve a corrosion resistant, non-metallic sealing surface.

It is a further object of the invention to provide a reciprocating piston and cylinder arrangement for a launching mechanism which avoids damage and/or failure of valves therein and improves usefulness and reliability of the launching mechanism.

It is yet another object of the invention to provide a cylinder and reciprocating piston assembly which is highly reliable and effective for maintaining a separation of corrosive fluids from structures exposed to the interior of the cylinder.

In order to accomplish these and other objects of the invention, a cylinder is provided for or together with a cylinder and reciprocating piston assembly including a metallic outer cylinder having an inner bore and an elastomer sleeve liner within the inner bore of the outer cylinder and compressionally preloaded in a radial direction about the circumference of the liner by the outer cylinder.

In accordance with another aspect of the invention, a method for making a corrosion-resistant cylinder is provided including the steps of placing a molded urethane elastomer liner within an inner bore of a rigid outer metallic cylinder, an outer diameter of the molded urethane elastomer liner being slightly larger than a diameter of the inner bore of said rigid outer metallic cylinder at an ambient temperature, the outer diameter of the molded urethane elastomer liner decreasing with decreasing temperature and the diameter of the inner bore of the rigid outer metallic cylinder increasing with increasing temperature, and preloading the molded urethane elastomer liner with the outer cylinder at an ambient temperature.

BRIEF DESCRIPTION OF THE DRAWINGS

The foregoing and other objects, aspects and advantages will be better understood from the following detailed description of a preferred embodiment of the invention with reference to the drawings, in which.

DESCRIPTION OF A PREFERRED EMBODIMENT

Figure 1:
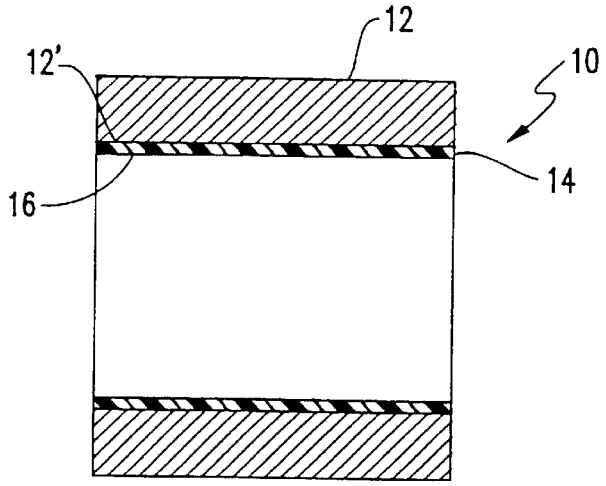
FIG. 1 is a cross-sectional view of a cylinder including a liner in accordance with the invention.

Referring now to the drawings, and more particularly to FIG. 1, there is shown a cross-sectional view of a cylinder assembly 10 including an outer cylinder 12 and liner 14 in accordance with the invention. Outer cylinder 12 is preferably cast of copper/nickel (CuNi) alloy and the inner bore 12' machined to a diameter slightly (preferably somewhat less than about one-eighth inch) larger than the desired final diameter of the inner bore 16 of the assembly 10. The outer surface of the outer cylinder 12 is not critical to the practice of the invention and various features such as mounting bosses can be integrally formed therewith. The thickness of the outer cylinder 12 is similarly not critical to the invention and can be sized to withstand anticipated pressures for a particular application by those skilled in the art.

It is to be understood that the proportions of FIG. 1, as shown, including a length of about twelve inches and an inner bore diameter of about nine inches, reflect those of an impulse cylinder which has been fabricated in accordance with the invention and tested to confirm the operability and meritorious effects thereof. However, the principles of the invention are applicable to cylinders of any size or proportions as may be required for particular applications.

Figure 2:
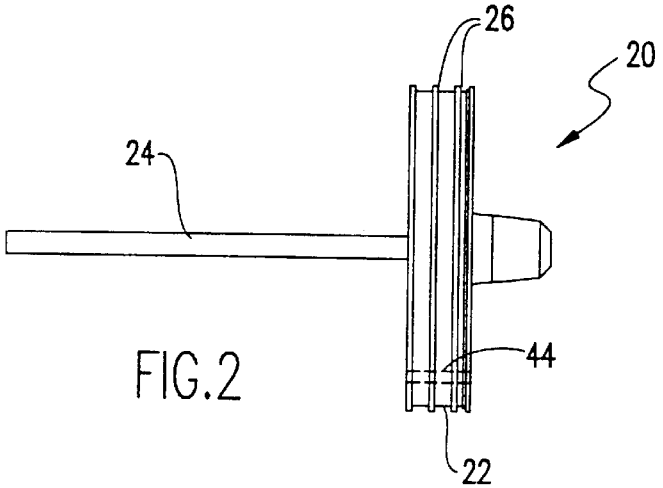
FIG. 2 is a side view of a piston usable with the cylinder of FIG. 2.

As shown in FIG. 2, a piston assembly 20 includes a piston 22 and an output drive shaft 24. Piston 22 is sized to fit closely but movably within a liner 14 of the cylinder assembly 10. Seals 26, preferably in the form of "C-rings" or the like (e.g. quad-rings) are preferably provided to improve sealing of the piston against the liner bore 16. Details of the piston and seals are not otherwise important to the practice of the invention and may be sized and proportioned to accommodate the intended application.

The liner 14, which may be retrofit into existing cylinder and reciprocating piston assemblies or originally manufactured therewith as will be described below, is preferably of cast urethane elastomer material having a tensile modulus (ASTM D 412) at 50% elongation of about 1500 psi to 2000 psi, an elongation at break of under 265%, a tear strength (ASTM D 470) of at least 115 PLI, hardness (durometer D) of at least 70, an abrasion index (ASTM D 1630) of 500% or greater and a compression modulus of 4000 psi or greater to produce a 10% deflection at a shape factor of 1.0. Such a material is commercially available from Gallagher Corp., located at 3966 Morrison Dr., Gurnee, Ill. 60031-1284, under the designation GC 1575. This material is extremely corrosion resistant and exhibits a high dielectric constant (7.21–8.74) and specific resistance $3.0\times10^{14}$–$6.1\times10^{12}$ ohms/cm) even at elevated temperatures (e.g., about 150° F.). Further, the material can be readily machined to a 16–32 RMS finish.

Figure 3:
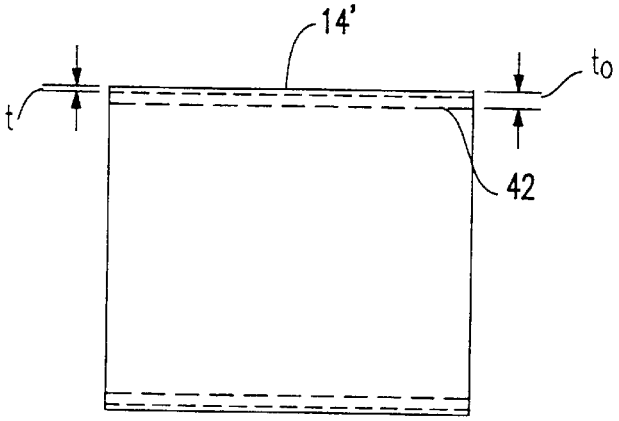
FIGS. 3 and 4 are side and end views, respectively, of a cylinder liner in accordance with the invention.
Figure 4:
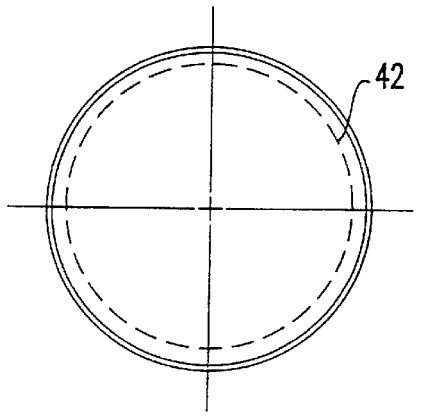

In this preferred application, only a small thickness of the liner 14 is required to prevent corrosion and consequent leakage past the piston and the thickness of the liner is not critical to the practice of the invention. It is preferred to cast or mold the liner to a thickness $t_0$ (as shown in FIG. 3) of about one-quarter inch (for example, to have sufficient thermal mass to warm sufficiently slowly to allow assembly at a given temperature as well as to prevent damage prior to installation), as shown by dashed line 42 in FIGS. 3 and 4, and, after installation within the outer cylinder, to machine the liner to a final thickness t of about one-sixteenth inch or even somewhat less when it is well-supported by the CuNi outer cylinder 12 in FIG. 1. Such a final thickness provides good tear resistance and adequately accommodates anticipated wear which can also be accommodated by seals on the piston.

The liner 14 is preferably installed in the outer cylinder 12 by machining the inner bore 12' of the CuNi outer cylinder 12 to a size slightly smaller than the outside surface diameter 14' (FIG. 3) of the liner 14 when the cylinder 12 and liner 14 are at the same temperature. The liner 14 is then preferably cooled to a temperature in the range of 0° F. to −20° F. for a period of six to eight hours which will cause sufficient contraction of the liner 14 to be accommodated within the inner bore 12' of the CuNi cylinder 12 at room temperature or an elevated temperature. This exemplary temperature range, the thermal conductivity of the elastomer, the elasticity at these temperatures and the preferred exemplary original thickness of the liner 14 maintain thermal gradients and resultant stresses in the liner 14 at levels below which damage will occur during cooling. Limiting the original thickness of the liner 14 also limits the amount of machining which will be required to reach the desired final internal bore 16 diameter. When the liner 14 returns to the same temperature as the CuNi cylinder 12, an interference fit will occur between the inner bore 12' of the outer cylinder 12 and the outer surface 14' of the liner 14 to retain the liner 14 firmly within the inner bore 12' of the CuNi cylinder 12.

Importantly, the interference fit will cause a substantial but non-critical compressional preload in the radial/circumferential direction (e.g., radially across the interface between the outer cylinder 12 and liner 14 around the circumference of the liner 14 and supported as a compressional force circumferentially around the liner) on the liner 14 which will further resist deformation of the liner 14 when high pressures are applied thereto. Further, if the coefficient of thermal expansion of the elastomer is fairly closely matched to that of CuNi, the interference fit of the assembly and resulting preload on the elastomer will be effective over a much wider range of temperatures than that required to achieve the interference fit. For example, the preload will be sufficiently maintained and the assembly will function over a range of temperatures from −60° F. to over 200° F., thus greatly exceeding the range of temperatures to which the assembly could possibly be exposed in a sea water environment. As will be understood by those skilled in the art,. lesser temperature differentials during assembly can be used to provide a sufficient interference fit and preload. This is especially true for cylinders of larger sizes. Alternatively to or in combination with shrink-fitting, as described above, the elastomer liner may be press-fit within the outer cylinder. However, such technique yields no relative advantage while incurring additional cost and are not preferred. Further, the preload in combination with the elasticity of the elastomer sleeve liner has been found to exclude corrosive materials from axial incursion at the metal-elastomer interface. The structural integrity of the cast elastomer sleeve is also reliably impermeable to fluids and gases.

The above-described cylinder/liner assembly 10 has been found to be highly resistant to corrosion due to long-term exposure to corrosive fluids such as sea water and to be of much increased reliability and working lifetime. Importantly, the onset of leakage, if any, is gradual and generally correlated with abrasion due to usage (and therefore predictable) and catastrophic failure of firing valves is effectively prevented. In addition, manufacturing costs are much reduced since the inner bore 12' of outer cylinder 12 need not be machined to as high a degree of smoothness as in previous impulse cylinders while the urethane elastomer can be machined to the required smoothness much more readily.

In comparison with coatings of elastomer or thermosetting materials, the cast or molded elastomer sleeve liner, supported by the preload of outer cylinder 12, in accordance with the invention can much more readily withstand shear stresses of machining which may damage even hard, inelastic, coatings and a smoother and more geometrically regular surface can be obtained suitable for direct contact with a Ni—Al—Br piston, sealing and liner wear assemblies. Further, the elasticity of the liner can reduce impulse stresses in the outer cylinder when rapid changes in applied pressure occur in normal operation and thus reduce wear on piston seals 26. In this regard and, in theory, for the same reason as well as some combination differing directions of pressure gradient across the piston and the structural integrity of the cast elastomer liner, occurrence of step deformations of the liner, such as those reported by Heiliger, have not been observed.

As a perfecting feature of the invention, should some leakage past the piston occur, the likelihood of catastrophic failure of the firing valve may be reduced by either of two further expedients which remove sea water from the cylinder. Specifically, a further pressure actuated valve can be provided in the high pressure piping supplying the cylinder which stays open to allow drainage at cylinder pressures of less than about 40 psi or a similarly functioning weep hole or valve 44 may be provided in the piston. While some loss of fluids which would otherwise contribute to pressure in the cylinder is unavoidable with either of these additional arrangements, the operation of the cylinder and piston arrangement in accordance with the invention is not discernably affected, largely because of the extremely short impulse pressures which are employed in the preferred application and the restriction on fluid movement through either the valve or weep hole. Removal of trace amounts of sea water from the interior of the cylinder by either or both of these techniques further tends to avoid corrosion and catastrophic failure of the firing valve and thus further improves reliability of the piston and cylinder assembly including the corrosion-resistant liner in accordance with the invention.

While the invention has been described in terms of a single preferred embodiment, those skilled in the art will recognize that the invention can be practiced with modification within the spirit and scope of the appended claims.

What is claimed is:

1. A cylinder assembly comprising:

a reciprocating piston having at least one seal thereon; and a cylinder housing comprising:

a metallic outer cylinder having an inner bore surface; and an elastomeric sleeve liner inside of the bore surface and contractable against the inner bore surface of the liner, which liner has an outer surface whose circumference is greater than the circumference of the inner bore surface, such that an interference fit occurs between the liner's outer surface and the bore's inner surface and the interference fit causes a compression al preload on the liner in the radial/circumferential direction that will resist liner deformation when pressures are applied to the liner at temperatures of −60° F. to 200° F.

2. A cylinder as recited in claim 1 wherein said elastomer sleeve liner is a molded urethane material.

3. A cylinder as recited in claim 1 wherein said elastomer sleeve liner is a molded urethane material having thermal shrink fit characteristics.

4. A cylinder as recited in claim 1 wherein said elastomer sleeve liner is comprised of a material having a durometer D hardness of at least 70.

* * * * *